United States Patent [19]

Sweetland

[11] 4,353,332

[45] Oct. 12, 1982

[54] CRANKCASE VENTILATING SYSTEM

[75] Inventor: Roger D. Sweetland, Columbus, Ind.

[73] Assignee: Cummins Engine Company, Inc., Columbus, Ind.

[21] Appl. No.: 221,766

[22] Filed: Dec. 31, 1980

[51] Int. Cl.[3] ..... F01M 13/02

[52] U.S. Cl. ..... 123/41.86; 123/196 CP

[58] Field of Search ..... 123/41.86, 572–574, 123/196 CP

[56] References Cited

U.S. PATENT DOCUMENTS

| | | | |
|---|---|---|---|
| 2,821,174 | 1/1958 | Scheiterlein | 123/41.86 X |
| 2,902,012 | 9/1959 | Malcolm | 123/41.86 |
| 4,103,650 | 8/1978 | Nishida et al. | 123/41.86 |

*Primary Examiner*—William A. Cuchlinski, Jr.

*Attorney, Agent, or Firm*—Neuman, Williams, Anderson & Olson

[57] ABSTRACT

A ventilating system is provided for the crankcase of an internal combustion engine. The system includes an engine block provided with a crankcase and an upright housing, the latter having a lower section communicating with the crankcase and an upper section provided with a vent to the exterior of the engine. A crankshaft is mounted within the crankcase and is drivingly connected to a pressure-generating means disposed within the housing upper section and adjacent the vent. The driven presssure-generating means effects a predetermined pressure within the housing which is greater than the exterior pressure of the engine.

7 Claims, 5 Drawing Figures

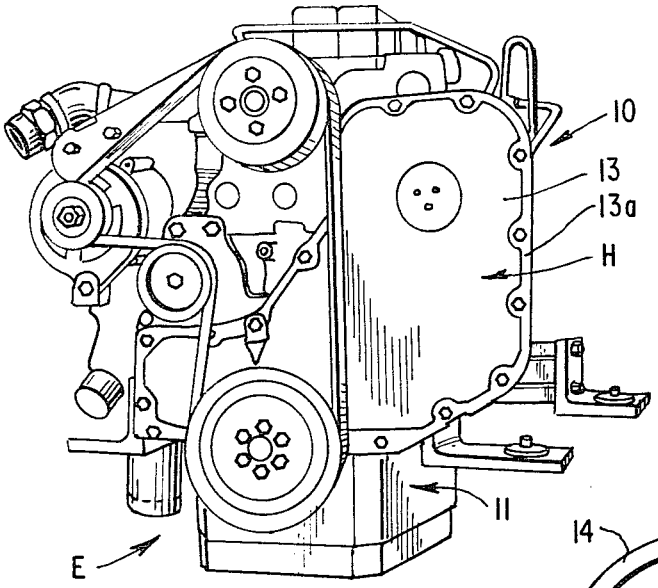
FIG. 1
FIG. 2
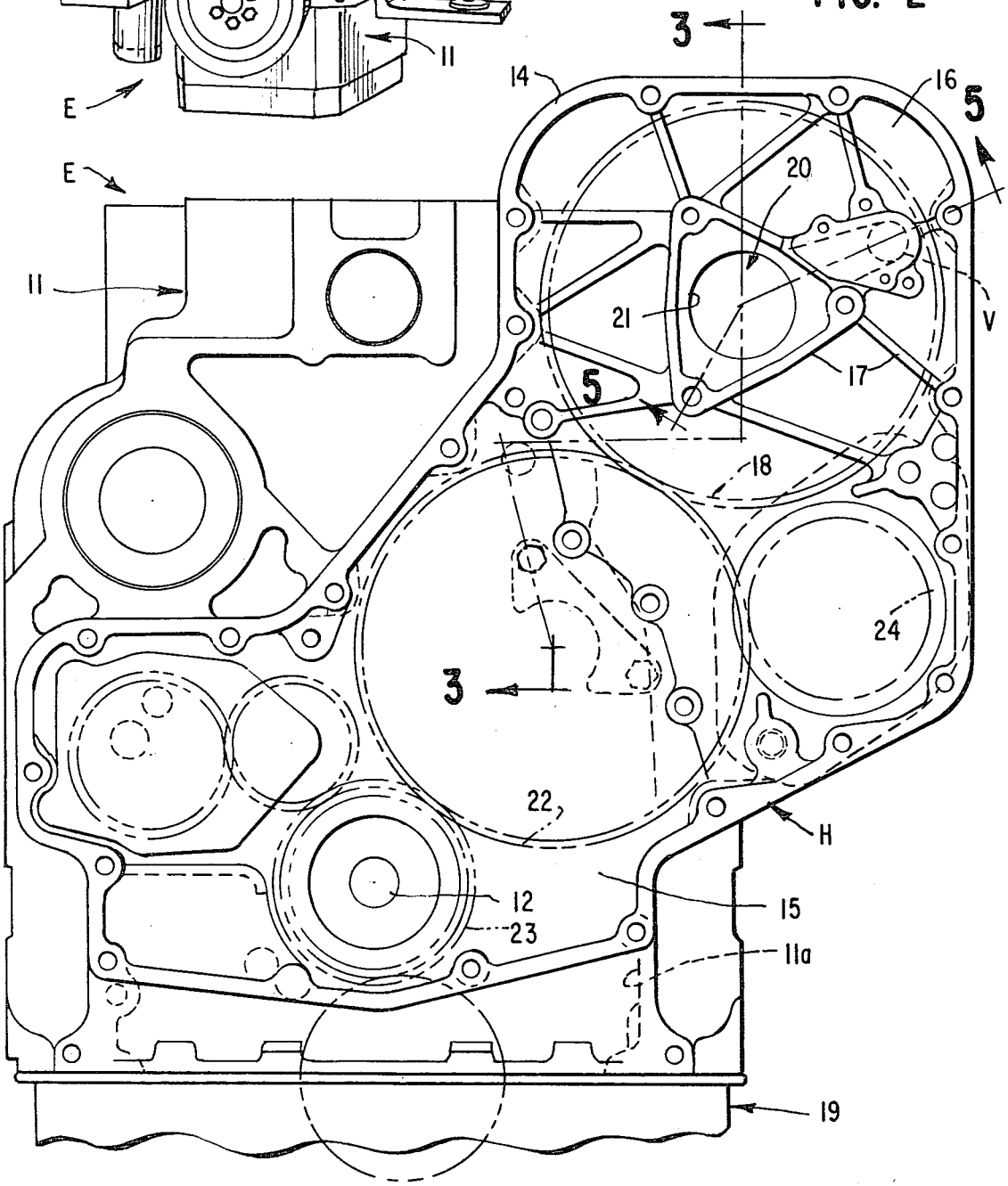

FIG. 3
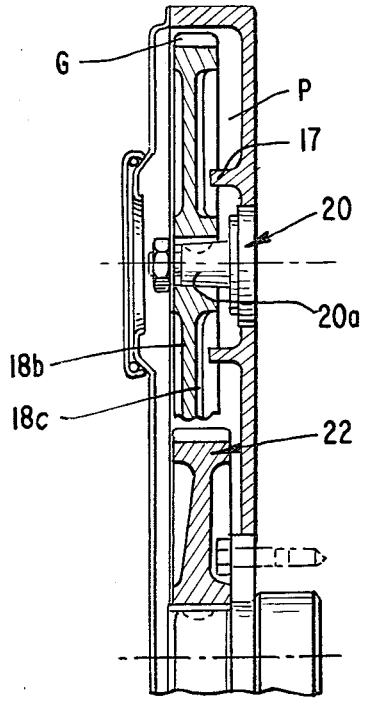
FIG. 4
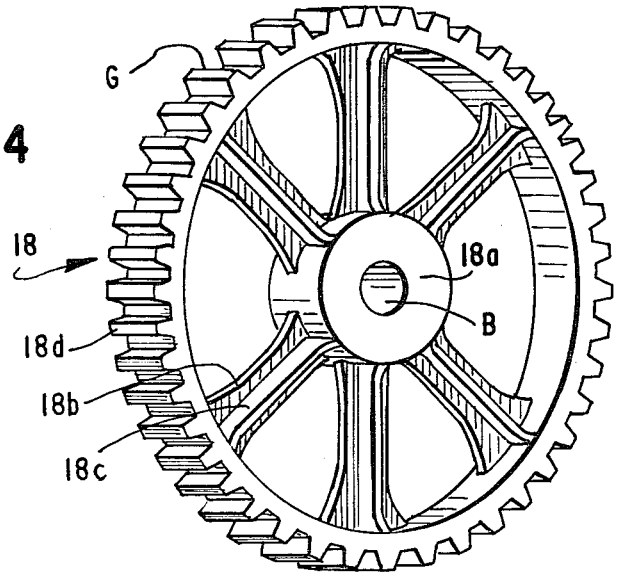
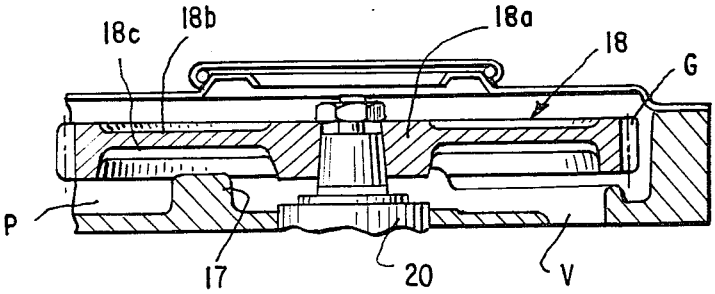
FIG. 5

CRANKCASE VENTILATING SYSTEM

BACKGROUND OF THE INVENTION

Proper ventilating of the crankcase of an internal combustion engine is important in order to effect separation of oil from the blow-by gases and thereby significantly reduce oil loss and contamination; and to prevent unfiltered air from being drawn in past the seals, gaskets and the like when the crankcase is subjected to periods of depression. Prior systems have heretofore been proposed in an attempt to overcome these problems; however, such systems have been beset with one or more of the following shortcomings: (a) the system is of complex and costly construction; (b) it is difficult to service and maintain; and (c) it is inefficient in operation.

SUMMARY OF THE INVENTION

Thus, it is an object of the invention to provide a crankcase ventilating system which avoids all of the aforenoted problems associated with prior systems of this general type.

It is a further object to provide a crankcase ventilating system which may be incorporated in internal combustion engines whicy vary in size and shape over a wide range.

Further and additional objects will appear from the description, accompanying drawings and appended claims.

In accordance with one embodiment of the invention, a crankcase ventilating system is provided for an internal combustion engine. The improved system includes an engine block having a crankcase and an upright housing and a crankshaft mounted within the crankcase. The upright housing has a lower section in communication with the crankcase and an upper section provided with a vent to the exterior of the engine. Pressure-generating means is disposed within the housing upper section adjacent the vent and is drivingly connected to the crankshaft. When the engine is operating, the means generates a predetermined pressure within the housing which is greater than the exterior pressure.

DESCRIPTION

For a more complete understanding of the invention, reference should be made to the drawings, wherein:

FIG. 1 is a fragmentary perspective end view of an internal combustion engine showing one form of the improved ventilating system incorporated therein.

FIG. 2 is an enlarged fragmentary front view of the housing of the system shown in FIG. 1 with the cover panel of the housing removed.

FIG. 3 is a fragmentary sectional view taken along line 3—3 of FIG. 2.

FIG. 4 is an enlarged perspective view of an impeller utilized in the improved system.

FIG. 5 is a fragmentary sectional view taken along line 5—5 of FIG. 2.

Referring now to the drawings and more particularly to FIG. 1, a diesel engine E is shown in which is incorporated the improved crankcase ventilating system 10. Basically, the engine E includes a block 11 in which a plurality of piston-cylinder assemblies, not shown, are disposed. The pistons are connected by suitable rods, also not shown, to a crankshaft 12 rotatably mounted in a conventional manner within a crankcase 11*a* formed in the lower portion of the block 11. Subtending the crankcase and secured to the underside of the engine block E is a conventional oil, or drain, pan 19.

Provided at one end of the engine block 11 is an upright housing H. Access to the interior of the housing is obtained by removing a cover plate 13. The periphery of the cover plate forms a ledge 13*a* which seals against a corresponding peripheral flange 14 formed in the end face of the block.

Housing H is provided with a lower section 15 communicating with the crankcase 11*a*, and an upper section 16 which is integral therewith and has a vent V to the exterior of the engine E formed therein. As seen in FIG. 2, the housing upper section 16 is provided with a plurality of ribs 17, the function of which will be described more fully hereinafter.

Rotatably mounted within the upper housing section 16 is an impeller 18, one form of which is seen more clearly in FIG. 4. The impeller includes a hub 18*a* having a center bore B formed therein and accommodating an end 20*a* of a shaft 20, the latter being supported within an opening 21 formed in the housing upper section 16. The impeller may function as the drive gear for an injector pump, not shown.

Radiating outwardly from hub 18*a* are a plurality of symmetrically arranged spokes 18*b*, each having formed in at least one face thereof, an elongated vane 18*c*. The vane is narrower than the spoke, is substantially coextensive therewith, and extends in an axial direction preferably a short distance. The outer ends of the spokes are interconnected by an annular rim 18*d*. The outer periphery of the rim 18*d* is provided with gear teeth G which mesh with the periphery of a camshaft gear 22. The camshaft gear is rotatably mounted within the housing upper section 16. The periphery of the camshaft gear 22 also meshes with a crankshaft gear 23, the latter being keyed to the end of crankshaft 12 and disposed within the housing lower section 15. Gear 22 may also mesh with a hydraulic pump drive gear 24, the latter being disposed within the housing upper section 16. The shape and size of the impeller and the number of vanes 18*c* formed therein may vary from that shown, if desired, and will depend on the pressure-buildup desired within the housing.

As seen in FIGS. 3 and 5, the impeller vanes 18*c* and the ribs 17 formed in the upper housing section 16 coact with one another to form a narrow tortuous passage P which terminates at one end at vent V. The vent is offset from the rotary axis of impeller 18. By reason of the tortuous configuration of passage P, an effective separation of the oil from the air circulating therethrough occurs. The separated oil flows by gravity to the housing lower section 15 where it then drains back to the oil pan 19.

Furthermore, by reason of the pressure-buildup within the housing, whenever the engine is operating, even at idle, there is no reverse flow of unfiltered air through vent V, seals, gaskets or the like into the housing interior.

By locating the housing at one end of the engine block, servicing and maintenance of the system 10 is greatly facilitated.

I claim:

1. A crankcase ventilating system for a multi-piston internal combustion engine, comprising an engine block provided with a plurality of piston cylinders, a crankcase and an upright housing disposed at one end of said block and spaced from the cylinders, said housing having a lower section communicating with the crankcase, an upper section provided with a vent to the exterior of the engine, and cover means removably mounted on said block end and overlying said upper and lower sections; a crankshaft mounted for rotation within said crankcase; drive means connected to said crankshaft and disposed within said housing lower section; and a vaned pressure-generating means rotatably mounted within said housing upper section and adjacent said vent, said vaned means being rotatably driven by said drive means and effecting a predetermined pressure buildup within said housing greater than the exterior pressure.

2. The ventilating system of claim 1 wherein the pressure-generating means includes a vaned impeller having the vanes thereof coacting with a plurality of ribs protruding from interior surface portions of said housing upper section to form a narrow tortuous flow path having one end thereof communicating with said vent and the other end communicating with said housing lower section.

3. The ventilating system of claim 2 wherein the drive means includes a gear train disposed within the housing for transmitting driving force from said crankshaft to said impeller.

4. The ventilating system of claim 2 wherein the vanes of said impeller extend substantially radially and axially relative to the rotary axis of said impeller.

5. The ventilating system of claim 4 wherein the vent is laterally offset relative to the axis of said impeller.

6. The ventilating system of claim 2 wherein the impeller includes a hub; a plurality of symmetrically arranged spokes extending radially from said hub; a rim interconnecting the outer end portions of said spokes; and a plurality of elongated vanes formed on said spokes and extending from at least one face thereof a predetermined amount in a substantially axial direction.

7. The ventilating system of claim 6 wherein the vanes and spokes are substantially coextensive and the rim is provided with peripheral gears.

* * * * *